US009900963B1

(12) United States Patent
Doll

(10) Patent No.: US 9,900,963 B1
(45) Date of Patent: Feb. 20, 2018

(54) LIGHTING CONTROLLER

(71) Applicant: Contemporary Communications, Inc., Saratoga, CA (US)

(72) Inventor: Joseph Doll, Saratoga, CA (US)

( * ) Notice: Subject to any disclaimer, the term of this patent is extended or adjusted under 35 U.S.C. 154(b) by 0 days.

(21) Appl. No.: 15/585,087

(22) Filed: May 2, 2017

Related U.S. Application Data

(60) Provisional application No. 62/408,317, filed on Oct. 14, 2016.

(51) Int. Cl.
*H05B 37/02* (2006.01)
*H05B 33/08* (2006.01)

(52) U.S. Cl.
CPC ..... *H05B 37/0263* (2013.01); *H05B 33/0845* (2013.01); *H05B 33/0857* (2013.01); *H05B 37/0272* (2013.01)

(58) Field of Classification Search
CPC H05B 37/02; H05B 37/0263; H05B 37/0272; H05B 33/08; H05B 33/0845; H05B 33/0857
See application file for complete search history.

(56) References Cited

U.S. PATENT DOCUMENTS

| | | | | |
|---|---|---|---|---|
| 6,285,140 | B1 | 9/2001 | Ruxton | |
| 6,744,223 | B2 | 6/2004 | Laflamme et al. | |
| 7,358,679 | B2 | 4/2008 | Lys et al. | |
| 7,759,881 | B1 | 7/2010 | Melanson | |
| 8,427,063 | B2 | 4/2013 | Hulett | |
| 8,587,223 | B2 | 11/2013 | Ilyes et al. | |
| 8,836,235 | B2 * | 9/2014 | Park | H05B 33/0815 315/224 |
| 9,155,174 | B2 | 10/2015 | Draper et al. | |
| 9,271,363 | B2 | 2/2016 | Takatsu | |
| 9,674,925 | B2 * | 6/2017 | Long | H05B 37/0209 |
| 2004/0017158 | A1 | 1/2004 | Ang et al. | |

(Continued)

FOREIGN PATENT DOCUMENTS

| | | |
|---|---|---|
| CN | 2634785 | 8/2004 |
| CN | 1829404 | 9/2006 |
| KR | 1020070062669 | 6/2007 |

OTHER PUBLICATIONS

Barros Soldera, Jefferson Daniel De et al; "Implementing a Lamp Dimmer with an HC908Q Family MCU"; Freescale Semiconductor, Application Note AN2839, Rev. 0, Sep. 2004; Sep. 2004; 24 pages.

(Continued)

*Primary Examiner* — Thai Pham
(74) *Attorney, Agent, or Firm* — Joseph Acayan

(57) ABSTRACT

Implementations generally relate to lighting control. In one implementation, a method includes receiving signaling modulations from a power line. The method further includes decoding data based on predetermined modulation characteristics of the signaling modulations, where the data includes one or more operational commands. The method further includes modifying performance parameters of one or more LED driver channel circuits based on one or more of the operational commands. In some implementations, the one or more LED driver channel circuits supply modulated drive current to one or more LEDs. In some implementations, the performance parameters effect brightness levels of the one or more LEDs connected to the one or more LED driver channel circuits.

20 Claims, 5 Drawing Sheets

500

(56) References Cited

U.S. PATENT DOCUMENTS

| | | | | |
|---|---|---|---|---|
| 2007/0171271 | A1* | 7/2007 | Wey | H05B 33/0827 347/237 |
| 2012/0074918 | A1* | 3/2012 | Shimomura | H05B 37/0245 323/282 |
| 2017/0055325 | A1 | 2/2017 | Rodinger et al. | |

OTHER PUBLICATIONS

Leibson, Steve; "How to Dim a LED"; Apr. 5, 2010; 1 page.

* cited by examiner

100

400

500

LIGHTING CONTROLLER

CROSS REFERENCE TO RELATED APPLICATIONS

This application claims priority from U.S. Provisional Patent Application No. 62/408,317, entitled "Lighting Controller," filed Oct. 14, 2016, which is hereby incorporated by reference as if set forth in full in this application for all purposes.

BACKGROUND

Light emitting diode (LED) lighting systems have gained in popularity, as LEDs are more efficient than incandescent alternatives. LEDs also support an adjustable color mix and support a rich array of control choices, such as color temperature adjustment, hue selection, and animated sequencing not available with traditional incandescent or fluorescent lighting systems. LED systems do present challenges and complexities. For example, traditional dimming controls are frequently incompatible with LED lighting. In particular, attempts to replace incandescent bulbs or string lights with LED bulbs or strips of equivalent luminosity may impair or negate the function of a dimming control that worked well with incandescent lighting.

SUMMARY

Implementations generally relate to lighting control methods and systems, and LED controllers. In one implementation, a method includes receiving signaling modulations from a power line. The method further includes decoding data based on predetermined modulation characteristics of the signaling modulations, where the data includes one or more operational commands. The method further includes modifying performance parameters of one or more LED driver channel circuits based on one or more of the operational commands. In some implementations, the one or more LED driver channel circuits supply modulated drive current to one or more LEDs. In some implementations, the performance parameters effect brightness levels of the one or more LEDs connected to the one or more LED driver channel circuits.

Other aspects and advantages of the described implementations will become apparent from the following detailed description, taken in conjunction with the accompanying drawings, illustrating by way of example the principles of the described implementations.

DETAILED DESCRIPTION

Implementations described herein enable lighting control. As described in more detail below, in various implementations, an LED controller receives signaling modulations from a power line. Such modulations may be produced by specially designed devices, or by standard devices including, but not limited to manual switches and dimmer switches commonly used to control incandescent bulbs. The LED controller decodes data based on predetermined modulation characteristics of the signaling modulations, where the data includes one or more operational commands. As described in more detail herein, in some implementations, the data to be decoded may be encoded manually at a light switch. In some implementations, data to be decoded may be encoded by standard dimmer controls commonly used for incandescent, dimmable fluorescent, or dimmable LED lighting systems. As described in more detail herein, in some implementations, the data to be decoded may be encoded at a remote digital device. The LED controller modifies performance parameters of one or more LED driver channel circuits based on one or more of the operational commands. In some implementations, the one or more LED driver channel circuits supply modulated drive current to one or more LEDs, and the performance parameters effect brightness levels of the one or more LEDs connected to the one or more LED driver channel circuits. In some implementations, multiple decoding methods may be implemented in a single LED controller. Such an LED controller may decode and act upon data encoded by any combination of manual switches, standard dimmers, or electronic switch controls.

Although implementations disclosed herein are described in the context of LED lighting, the implementations may also apply to other types of lighting, depending on the particular implementation.

Figure 1:
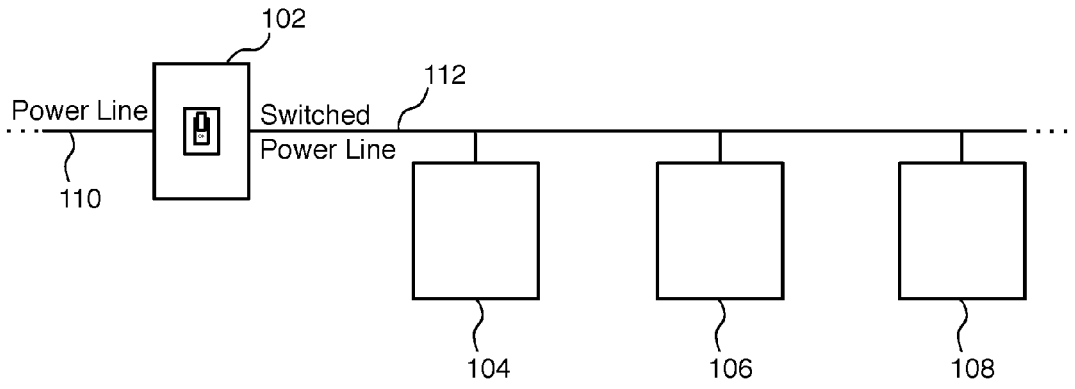
FIG. 1 illustrates a block diagram of an example lighting environment, which may be used for some implementations described herein.

FIG. 1 illustrates a block diagram of an example lighting environment 100, which may be used for some implementations described herein. As shown, lighting environment 100 includes a light switch 102, and fixtures and/or bulbs 104, 106, and 108. In various implementations, the LED controller may be incorporated/integrated into fixtures, LED power supplies, and/or bulbs.

As shown, light switch 102 receives power from a power line 110 and feeds power to fixtures or bulbs 104, 106, 108, etc. via switched power line 112. As described in more detail herein, an LED controller modifies performance parameters of one or more LED driver channel circuits based on one or more operational commands, where the one or more LED driver channel circuits supply modulated drive current to one or more LEDs.

For ease of illustration, FIG. 1 shows 3 blocks that represent fixtures or bulbs. Lighting environment 100 may have any number of fixture and/or bulbs. In various implementations, lighting environment 100 may not have all of the components shown and/or may have other elements including other types of components instead of, or in addition to, those shown herein.

Figure 2:
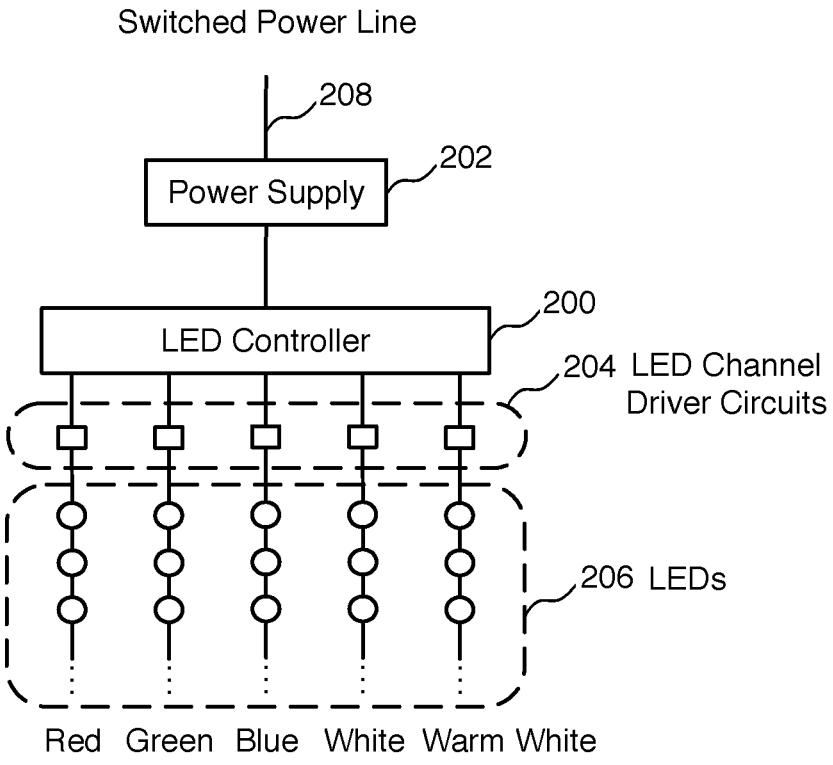
FIG. 2 illustrates a block diagram of an example LED controller, which may be used for some implementations described herein.

FIG. 2 illustrates a block diagram of an example LED controller 200, which may be used for some implementations described herein. As shown, LED controller 200 is operatively coupled to a power supply 202, one or more LED driver channel circuits 204, and one or more LEDs 206.

In various implementations, LED controller 200 may be integrated into various types of systems. For example, such a system may be a fixture that includes the LED controller, or an LED power supply that includes the LED controller, or a light bulb that includes the LED controller, or a light switch that includes the LED controller, etc.

Also shown, power supply 202 receives alternating current (AC) from switched power line 208. Power supply 202 converts the AC current to direct current (DC). LED controller 200 receives the DC and feeds LED driver channel circuits 204, which in turn drive LEDs 206. While some implementations are described herein in the context of an AC power line, these implementations and others may also apply to power supply 202 receiving DC from a DC power line. In some implementations, if the DC power line is of a voltage directly compatible with LEDs 206, power line 208 may be directly connected to LED controller 200 without need for an intervening power supply 202.

In various implementations, LEDs 206 may include one or more red LEDs, one or more green LEDs, one or more blue LEDs, one or more white LEDs, and one or more warm white LEDs, and any combination thereof, or arbitrary combinations of other colors.

In various implementations, LED controller 200 may include one or more processors. In various implementations, LED controller 200 includes one or more LED driver channel circuits 204 operatively coupled to and able to be activated by or activatable by the one or more processors. In various implementations, LED driver channel circuits 204 supply modulated drive current to one or more LEDs.

As described in more detail herein, in some implementations, the LED controller may include logic encoded in one or more non-transitory computer-readable storage media for execution by the one or more processors. When executed, the logic is operable to perform operations associated with implementations described herein.

Figure 3:
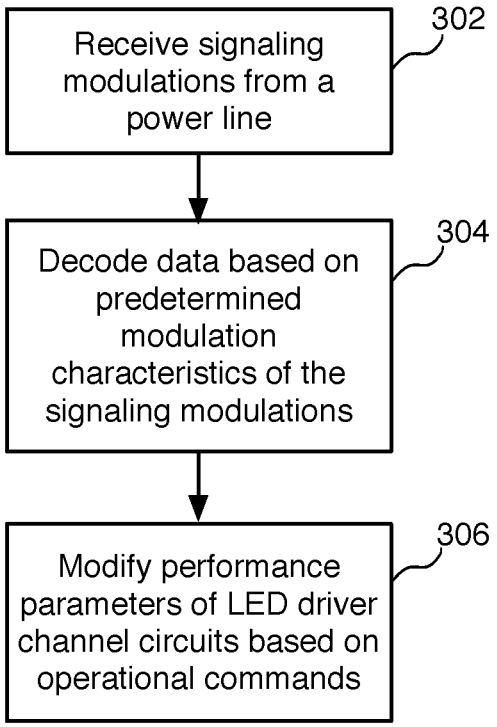
FIG. 3 illustrates an example flow diagram for controlling lighting, according to some implementations.

FIG. 3 illustrates an example flow diagram for controlling lighting, according to some implementations. Referring to both FIGS. 2 and 3, a method is initiated at block 302, where LED controller 200 receives signaling modulations from a power line. In some implementations, the signaling modulations may be based on power interruptions.

At block 304, LED controller 200 decodes data based on predetermined modulation characteristics of the signaling modulations. In various implementations, the data includes one or more operational commands. As described in more detail herein, LED controller 200 may decode manual and/or electronic commands. In various implementations, the data to be decoded may be in the form of analog signals during transmission over the power line. In various implementations, digital encoding schemes may be employed for transmission of data. In various implementations, a mixture of analog data and digital data transmission methods may be used.

At block 306, LED controller 200 modifies performance parameters of the one or more LED driver channel circuits based on one or more of the operational commands. In various implementations, the one or more LED driver channel circuits supply modulated drive current to one or more LEDs. In various implementations, the performance parameters effect brightness levels of one or more LEDs connected to the one or more LED driver channel circuits.

In various implementations, LED controller 200 detects and decodes signals modulated at a predetermined synchronizing frequency. In some implementations, LED controller 200 synchronizes to the predetermined synchronizing frequency or an "imaginary oscillator" (e.g., in the 50-60 Hz range, etc.). For example, a detector assuming 55 Hz could be designed to work with a transmitter that uses either 50 or 60 Hz. This implementation enables (but does require) signals originating at the switch to be synchronized to the AC power line. As such, the interference reduction associated with physical half-cycle suppression could be realized. If not, interference would still be less than that of a standard dimmer. The scheme could also support two-way communication.

In some implementations, an imaginary oscillator may refer to a way in which signals may be generated, and what may be expected by a corresponding detector. The signal detector function of the LED controller processor may be programmed to expect and recognize the signal characteristics that the switch would generate. Synchronizing to a predetermined synchronizing frequency or imaginary oscillator has an advantage of being able to modulate a DC power line which has no natural synchronization frequency.

In some implementations, LED may also synchronize at higher frequencies (e.g., 1 KHz, etc.) to the power line. The particular method, whether synchronized to the power line, to an imaginary oscillator, etc., will depend on the particular implementation.

In some implementations, the data to be decoded is encoded by modulating a subset of alternating current (AC) cycles of drive current to in turn provide modulated drive current to the one or more LEDs. In some implementations, the modulated AC cycles transmit data. In some implementations, the unmodulated AC cycles supply power to the one or more LEDs. Specific implementations of the encoding method may vary and may be optimized for an intended application. Important considerations include cost of encoding circuitry, computational intensity of decoding by the controller, availability of existing encoding devices, data rate supported, reliability of operation and freedom from causing or being affected by interfering signals. Several standards exist which may be used. Examples include home automation standards, power line communication standards, broadband over power line standards, etc. While workable, most such methods are intended to propagate data throughout a power line system, creating potential interference in non-targeted areas. Their relatively high data rates are unnecessary for lighting control. Implementation costs are relatively high.

In contrast, the modulation methods described herein employ brief power interruptions while maintaining a high average duty cycle of the AC power line, which appears well matched to the purpose. In various implementations, the modulation methods affect circuitry downstream of the encoding device. Proven operation of existing, inexpensive TRIAC-based standard dimmer controls support this match, even though they do not maintain a high average duty cycle of the AC power at low dimming levels.

Implementations enable encoding of arbitrary data and enable detection of when a transmission is complete. In various implementations, data is encoded at the switching point (e.g., light switch). It is a switch, either electronic or manual, that may cause the interruptions. Standard dimmer controls constitute a class of electronic switches whose characteristic switching patterns, synchronized to the AC power line, may be characterized, decoded, and interpreted by the LED controller. An overall appeal is that control takes place where it "naturally should"—the light switch. It obviates the need for remote devices that have no natural location, and are vulnerable to numerous sources of interference. In some implementations, a given light switch may be controlled by an electronic device.

The following implementations are directed at user-provided commands originating at a power switch. In various implementations, the data to be decoded is encoded manually at a light switch, or any suitable manually operated power switch. LED light sources are typically powered by LED drivers or LED power supplies that convert power from an AC power line to a steady direct voltage or current compatible with LED emitters. The terms "LED driver" and "LED power supply" may be used interchangeably. For clarification, note that an LED driver or LED power supply is distinguished from an LED driver channel circuit, which is described in more detail herein in connection with FIG. 4.

In various implementations, an LED power supply converts AC to DC, whereas an LED driver channel circuit performs a final adjustment in connecting the LED power supply to its load. In the case of unusually large or varied loads, each of multiple LED driver circuits may be used to assign a discrete subset of the aggregate load to a particular one of multiple LED power supplies, while operating in coordination with other LED driver circuits to maintain unified control of the aggregate load. In some implementations, each of the multiple LED power supplies may be connected to its assigned portion of the aggregate load via one or more LED driver circuits. Also, an LED power supply may be designed to accept a wide range of inputs, whereas an LED driver circuit is designed to work with the specific output the LED driver or LED power supply is designed to provide. In various implementations, such LED drivers or LED power supplies may be incorporated within LED replacement bulbs, and supplied separately for use with LED strips.

In various implementations, LED power supplies may accept a wide range of power voltages and frequencies, and convert any applied power input to the same DC output. In consequence, common dimmers that operate by interrupting portions of the input power on a cycle-by-cycle basis are likely to have little or no range of continuous control. Implementations described herein can economically enable responsiveness to common dimming controls while still accommodating a wide range of power voltage and frequencies.

In some implementations, LED luminaires and stand-alone LED power supplies may incorporate additional circuitry to sense the effects of common dimmers and adjust output accordingly. In some implementations, the LED controller described herein may economically replace such complex circuitry designed to respond to common dimmers.

Implementations described herein address the following issues. Some stand-alone LED power supplies provide for a dimming signal that may be applied to an additional wire pair. This approach is not practical for many incandescent replacements, where the additional wiring is not in place. For LED strip lights, separate LED controllers, including multi-color units, are available that connect between the power supply and the LED strip to perform dimming and/or color adjustment functions. They are typically operated by wireless remote controls, either infrared or radio/WiFi. Such controls are not suitable where barriers to infrared or radio signals, or interfering signals, exist. Counterintuitively, if such LEDs are powered via a standard wall switch, the switch must be left on when LEDs are off to enable them to be turned on again with wireless controls.

Implementations described herein address these issues with alternative dimming and color control circuitry that may be incorporated in dimmable bulbs and stand-alone LED power supplies, or as a direct replacement for wirelessly operated dimming and color control devices. As a modification to dimmable LED power supply circuitry or a replacement for stand-alone wireless controller circuits, net cost should be near zero, and could be negative.

At the power switch/user interface location, net cost is likely to be negative. For economy, a simple on/off toggle switch can be used effectively to control the dimming and color control circuitry. If desired, an arbitrary user interface can be incorporated with the switch to include knobs, sliders, level indicators, push buttons, touch screens, or wirelessly operated mobile controls. Such a user interface may be used to operate the simple switching function electronically to improve user experience. Alternatively, if desired, implementations may use a standard dimmer control to signal a desired dimming level. The dimmer control's characteristic output may be appropriately interpreted and acted upon by the LED Controller.

In some implementations, one or more operational commands may be selectively sent by one or more data encoding devices to one or more LED controllers via one or more respective power lines. Each of the LED controllers thereby assumes either a selected status or an unselected status with respect to the one or more operational commands. In various implementations, each LED controller either acts upon or ignores the one or more operational commands in accordance with its selected or unselected status. In some implementations, a "controller select" command may be followed by one or more operational commands. The selection may remain active until another "controller select" command is sent. The "controller select" command may have a value of "all", probably represented by address 0 or "*".

In some implementations, each LED controller may have an addressability function that enables a given LED controller to determine whether a particular operational command has been selectively sent to it, or was instead intended for one or more other LED controllers that may be connected to the same power line, and should therefore be ignored. In some implementations, the data transmitted may include one or more recipient indications (e.g., addresses) that indicate one or more intended or target LED controllers. For example, in some implementations, a given LED controller may receive transmitted data, and then determine if the given LED controller is the intended recipient of the data based on one or more recipient indications in the data. In some implementations, each operational command may be associated with one or more recipient indications. In various implementations, unselected LED controllers would ignore received operational commands that are not targeting the unselected LED controllers.

In some example implementations, consider a data encoding device that sends a command selectively to LED controllers having addresses 2 or 4 or 5. If three downstream LED controllers have addresses 1, 2, and 3, respectively, exactly one of those three LED controllers will execute the command (e.g., the LED controller having the address 2), and two LED controllers will ignore it (e.g., the LED controllers having the addresses 1 and 3). If their addresses are 1, 3, and 6, all three LED controllers will ignore the command, and none will execute it. If their addresses are 2, 4, and 5, all three LED controllers will execute the command, and none will ignore it.

In some implementations, the LED controller, either stand-alone or incorporated into an LED power supply, may detect timing characteristics of manually controlled power interruptions and applications, and modify its performance parameters in accordance with a predetermined significance of said interruptions and applications. In some implementations, a particular significant sequence may be a "command," and all such sequences may be referred to as a "command set."

In some implementations, the LED controller may be responsive to commands defined such that the commands may be manually originated using a simple power switch. In some implementations, the LED controller may detect, as a basis for interpreting commands, one or more switching gestures including off or on round trip excursions, or "nudges" of the power switch. For example, an "off nudge"

may involve the user quickly nudging or clicking off the light switch and turning the light switch back on. This quick power cycling results in a brief power interruption (e.g., on the order of 0.5 seconds, etc.) preceded and followed by a period of continuous power. In some implementations, an "on nudge" may be a similarly brief application of power preceded and followed by no power. In various implementations, the term "off nudge" may be used interchangeably with the terms "quick off," "off cycle," or "off click." As described in more detail herein, various numbers of nudges or clicks (e.g., double/triple/n-tuple clicks, etc.) in rapid succession may be used for some functions.

In some implementations, the LED controller may interpret an off nudge as a "Dim one increment" command. In some implementations, the LED controller may interpret an on nudge followed by reapplication of power within a moderately short period (e.g. on the order of 5 seconds, etc.) as a "Brighten one increment" command.

In some implementations, the LED controller may interpret an on nudge followed by a substantial unpowered interval (e.g., on the order of 6 seconds, etc.) as a "Set default brightness" command. When power is reapplied, LED brightness is returned to the level in effect immediately preceding the most recent Set default brightness command. In some implementations, when a default brightness is set between maximum and minimum levels, the LED controller may increase the number of dimming increments between default and minimum and between default and maximum.

In some implementations, the LED controller may interpret two consecutive on nudges followed by a substantial unpowered interval as a "Reset default brightness to maximum" command. In some implementations, the LED controller may interpret multiple consecutive on nudges followed by a substantial unpowered interval as a "Mode select" command, as shown in the following table.

| # On Nudges + Power off | Mode | Description |
|---|---|---|
| 1 or 2 | All Channel Control | On reapplication of power, off nudges control dimming, and on nudges control brightening, of all channels |
| 3 | Program Select | On reapplication of power, step through available animation effects in response to off nudges |
| n (>3) | Channel Select | On reapplication of power, an individual color, channel n-3, is selected as target of "Dim one increment" and "Brighten one increment" commands |

In some implementations, in addition to adjusting default brightness, the LED controller may enable a user to cancel Program Select or Channel Select modes. In some implementations, the LED controller may interpret a single off nudge as a "Ramp brightness level" command, and a subsequent off nudge during the ramp period as a "Select brightness level" command at the then-current level.

In some implementations, the LED controller may ramp the brightness downward if current brightness level is maximum, may ramp the current brightness upward if current brightness level is minimum, otherwise opposite the most recent previous ramp direction. In some implementations, the LED controller may ramp the brightness downward to minimum brightness value, and cause dimming effects such as flickering illumination similar to candlelight and/or changes in color temperature.

In some implementations, the LED controller may simultaneously control the brightness level based on multiple independent channels (e.g., Red, Green, Blue) and maintain the relative brightness ratio of each channel with respect to the others.

In some implementations, the LED controller may select a single channel for the brightness level setting by a rapid succession of n+y off nudges, where n is the targeted channel number and y is a design parameter. In some implementations, the LED controller may visually indicate and confirm the targeted channel by illuminating that channel with one or more flashes while suppressing other channels.

In some implementations, the LED controller may interpret a rapid succession of p off nudges and subsequent off nudges in non-rapid succession in order to step through available animation effects, where p is a design parameter. In some implementations, an animation selection mode may be selected.

In some implementations, the LED controller may return to its most recently set brightness and/or animation settings after a substantial period of no power. In some implementations, this may be achieved by storing key state variables in non-volatile memory when the duration of a power interruption approaches the maximum uninterruptible time of the microprocessor power supply. When the processor subsequently restarts, it reads stored state variables and initializes their values in volatile operating memory. Variables so stored depend on the specifics of the algorithm used to implement operating logic. For example, a "Mode" variable that may be set to values of "Steady," "RampUp" or "RampDown," along with numeric brightness variables "CurrentLevel" and "PreviousSteadyLevel" may be sufficient to restore the state of simple dimming logic so that LEDs initialize with the same brightness and dimming status they had prior to power loss.

In some implementations, additional variables, such as "AnimationState" and associated numeric variables, or an array of state variables for multi-channel applications, may be used to restore more complex state possibilities. Absent stored status data, the microprocessor may assume a default status, such as "CurrentLevel=MaxLevel" and "Mode=Steady," or "CurrentLevel=MinLevel" and "Mode=RampUp."

In some implementations, a manually signaled control may operate while connected to the low voltage side of an LED power supply. This reduces both cost and hazard worries. The manual scheme may still be implemented with an electronic switch that presents a fancy user interface.

In various implementations, the data to be decoded may be encoded at a remote digital device. In some implementations, the operational commands received solicit a response from the LED controller. In some implementations, the controller encodes responsive data for delivery by any suitable means, including in a form of predetermined variations in the current drawn from the remote digital device. Suitable means of encoding response data may vary and will depend on the particular implementation. For example, in some implementations, the predetermined variations may be employed to encode data for other transmission means, including radio frequency (RF) or infrared (IR) wireless transmissions, agile LED flashing, etc.

Implementations described herein eliminate the need for control circuits commanded by complex wireless remote controls, whether infrared, radio, or WiFi, that are subject to transmission barriers and interference. The drawbacks of such problematic devices are addressed by locating the command originating device at the power switch, and communicating with power line modulations that are reliable and economical to decode. The switch/command point is a superior place to add a network connection, as it can serve multiple bulbs or other lighting devices. Further, the single network connection is an optional enhancement, not a mandatory cost burden on each bulb or lighting device. A single network connection added at the power switch/command origination location can enable "smart home" control for multiple LED lighting devices.

Implementations described herein address these issues with alternative control circuitry activated by connection to the AC power line that may be incorporated into high function LED bulbs and stand-alone LED driver channel circuits, or as a direct replacement for wirelessly operated control devices. As a modification to high-function driver control circuitry, or as a replacement for stand-alone wireless control circuits, net cost should be near zero, and could be negative.

At the power switch/user interface location, net cost is likely to be negative. For economy, a suitable user interface can be presented by an electronic switch that controls LED systems with commands transmitted by the AC power line. Such a user interface may be implemented with an arrangement of buttons, sliders and knobs and/or a touch screen. If desired, the control location may also incorporate a network connection to enable remote control similar to that of alternative systems, while entailing less technical complexity.

The following implementations are directed at user-provided commands originating at a remote digital device. In some implementations, the LED controller may detect timing characteristics of brief power interruptions, and modify its performance parameters in accordance with a predetermined significance of the interruptions. In some implementations, a particular significant sequence may be a "command," and all such sequences may be referred to as "command set." In some implementations, the LED controller may detect data encoded as a sequence of power interruptions, which occur in compliance with predetermined timing characteristics.

In some implementations, the LED controller may receive and decode data, which is encoded in the form of power interruptions, which are synchronized to the waveform of the AC power line. In some implementations, the LED controller may receive and decode data, which is encoded by modulating a carrier waveform superimposed on the AC power line. In some implementations, no power interruption associated with signaling is longer than one complete AC power line cycle in duration, and each such interruption is preceded by at least two full cycles of uninterrupted power.

In some implementations, power interruptions may occur in discrete half cycle increments, beginning and ending at points where the AC power waveform crosses zero. This optional provision minimizes radio interference that may otherwise arise from switching transients.

In some implementations, the signaling data may be organized as a sequence of predetermined number of bytes (e.g., 1 or more 8-bit bytes). In some implementations, the beginning of a data byte is indicated by a power interruption spanning two successive half cycles (e.g., one full cycle) of the AC power line, preceded by at least two uninterrupted cycles. Polarity of the interrupted cycle is immaterial.

In some implementations, full commands may involve several bytes. In some implementations, the content of bytes may be ASCII characters. In some implementations, numeric values may be encoded as hexadecimal strings. In some implementations, data or commands may be terminated with a predetermined symbol (e.g., a semicolon character, etc.).

In some implementations, data bits of each byte may be encoded by interrupting or not interrupting a predetermined number of half cycles (e.g., 8 half cycles) of a predetermined number of data active cycles (e.g. 4 specified data active cycles), following a single suppressed (interrupted) cycle, which began the byte. For example, in some implementations, 4 data active cycles may include the third of each of 4 groups of 3 cycles immediately following the full interrupted cycle indicating the beginning of a byte. In this example, the byte onset indication, followed by 8 data bits, may be thereby encoded within a span of 15 AC power line cycles.

In some implementations, the LED controller may decode strings of multiple bytes that represent operational commands within a predetermined command set, and responding appropriately to the commands.

In some implementations, the LED controller may interpret an uninterrupted period of a predetermined number of power line cycles (e.g., 15 AC power line cycles) as an end of transmission indicator. In some implementations, the LED controller may optionally initiate a transmission of responsive data on the AC power cycle immediately following the end of transmission event.

In some implementations, the LED controller may effect transmission of response data in compliance with the encoding methods described herein used for received data, except by interrupting, to below a predetermined low level, or not interrupting its own current draw from its connected AC power line. Half-duplex data responses to the controlling device responses are thereby enabled (e.g., ACK/NACK, etc.).

In some implementations, the LED controller may be responsive to commands so defined as to be compatible with an electronic switch capable of very brief power interruptions, and optionally compatible with any combination of signaling described herein. In some implementations, the LED controller may enable a suitable user interface for a command set based on an electronic AC power switch and/or interrupter and any combination of signaling methods described herein.

In some implementations, the LED controller may generate half-duplex responses. In some implementations, the remote digital control device may receive and interpret the half-duplex responses from the LED controller by waiting one additional full power cycle after ending a logical transmission before initiating a new forward transmission, and sensing whether the AC power line current is below a predetermined threshold during that power cycle. In some implementations, the remote digital control device may support half-duplex responses from the LED controller by waiting for an indicated half-duplex response to be completely received before initiating a new forward transmission.

Implementations may eliminate discrete half cycles to encode data. For example, the light switch may restrict itself to turn on and off only at zero crossing points of the AC waveform. The surviving waveform would then appear only in half cycle increments.

The interference reduction associated with physical half-cycle suppression may be realized. If a switch is turned on or off at any point other than a zero crossing, the resulting waveform has a sharp "edge" where it "jumps" between the level of the waveform at that point and zero. Such edges are associated with high frequencies, and commonly cause radio interference.

In some implementations, a predetermined amount of data (e.g., a byte or 8 bits, etc.) may be transmitted over a predetermined period (e.g., 15 AC line cycles, etc.). Such 15 cycles may include 5 groups of 3. In each group of 3, only the first cycle would be modulated, while the other two would pass unimpeded. That assures a reasonable level of continuing power flow. As such, there would be a sequence of 5 modulatable cycles, each consisting of two half cycles. In some implementations, the data encoding device may suppress both halves of the first modulatable cycle, and may thereby form a "wake up" signal that live data follows, and that may be detected by the LED controller. In some implementations, the data encoding device may suppress or pass each half cycle of a predetermined number of modulatable half cycles (e.g., 8 of the following modulatable half cycles) in accordance with the data bits to be transmitted. wherein such data may be detected by the LED controller.

Some implementations provide feedback communications via current consumption modulation. Assuming a modulation scheme that relies on a sequence of power interruptions, that same modulation scheme can be mimicked by generating a similarly timed sequence of load current pulses. To generate them, the LED controller may either switch its LEDs on and off, or switch some other load. The electronic switch would monitor load current variations, much as the LED controller processor monitors power variations in order to receive its response.

In various implementations, the predetermined modulation characteristics of the signaling modulations include power interruptions. In an example scenario, one particular case of encoding exclusively by power interruptions is found in common dimmer controls designed for incandescent, fluorescent, or LED lamps. In some implementations, such dimmer controls may operate by interrupting a portion of each AC power line half cycle. When applied to an incandescent bulb, power delivered to the bulb may be reduced by the interrupted portion of the waveform, causing the bulb to illuminate with reduced intensity. When applied to fluorescent or LED luminaires that contain a power supply, dimming may or may not occur depending on power supply design characteristics.

Power supply incompatibilities have created a need for more complex and expensive dimmer controls that use different circuitry to effect power interruptions. However, in some implementations, the LED controller may sense and characterize the power interruptions produced by common dimmer controls, and effect appropriate brightness control via its LED driver channel circuits.

To characterize AC power interruptions imposed by standard dimmer controls, it is possible, but not necessary or sufficient, to sense the duration of each interruption. In some implementations, a computationally less intensive method is for the LED controller to sample the on/off status of the AC waveform at a rapid periodic rate, and to calculate the duty cycle of the waveform by averaging over an appropriate sampling period. By employing this technique, the LED controller may effectively convert an otherwise non-dimmable LED power supply into a dimmable supply. In some implementations, the LED controller may adjust the LED dimming profile such that minimum brightness is produced at any AC power line duty cycle below a level at which the power supply may cease to function. This permits full dimming range, below which lights may turn off completely. Similarly, it is desirable to compensate for standard dimmer controls that may impose an AC duty cycle less than 100% when its control is set for maximum brightness. Controlling LEDs to 100% brightness for AC line duty cycle above about 95% assures widest possible dimming range and full use of the LED's illumination capability.

In various implementations, one or more of the operational commands are selectively sent by one or more data encoding devices to one or more LED controllers via one or more respective power lines. For example, in some implementations, operational commands may be broadcast to several devices on the same power line (e.g., like a dimmer for several fixtures), and/or directed to a specific selected fixture or set of selected fixtures while not affecting others. For a multiple-bulb fixture, each bulb may have its own address, where the bulbs may be animated in a coordinated pattern by a single switch. In various implementations, the LED controller may receive a unique address and/or group identifier, and ignore commands intended uniquely for others. The LED controller may selectively act upon or ignore messages depending on the selected scope. In various implementations, the terms sent transmitted, signaled, and communicated may be used interchangeably.

In some implementations, the power lines may include power line segments that carry power from a switching point downstream to one or more LED controllers. Note there could be multiple 3-way switching points passing power to the LED controller, or multiple LED controllers on the same switched line. Unlike with standard dimmers, the LED controllers may be commanded from any switching point. In various implementations, an advantage of power interruption signaling is that it affects only downstream devices. This is in contrast with some smart home communications, which attempt to broadcast signals all over the house, and sometimes may seep into neighboring houses.

Although the steps, operations, or computations may be presented in a specific order, the order may be changed in particular implementations. Other orderings of the steps are possible, depending on the particular implementation. In some particular implementations, multiple steps shown as sequential in this specification may be performed at the same time. Also, some implementations may not have all of the steps shown and/or may have other steps instead of, or in addition to, those shown herein.

Figure 4:
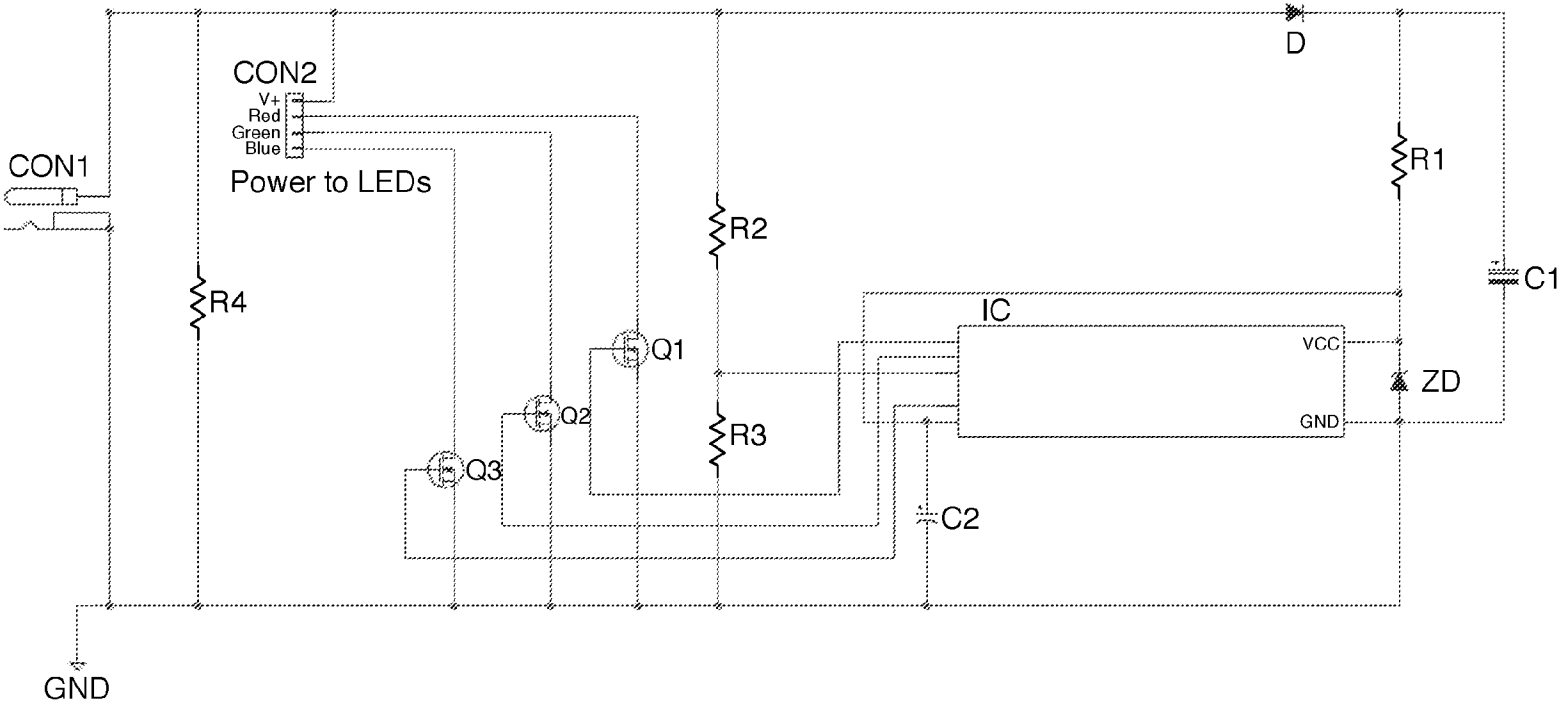
FIG. 4 illustrates a schematic diagram of an example LED controller, according to some implementations.

FIG. 4 illustrates a schematic diagram of an example LED controller 400, according to some implementations. The schematic diagram of FIG. 4 is one example implementation of LED controller 400. Other schematic diagrams are possible, depending on the particular implementation. In various implementations, LED controller 400 may run off the output of a power supply (not shown) via connector CON1. The power supply also powers the controlled LED strip via connector CON2. The size of the power supply may vary, depending on the particular implementation. For example, the power supply may be a 12-volt power supply, 24-volt power supply, etc.

DC power is applied to a processor or integrated circuit (IC) pin through a resistive voltage divider (resistor R2 and resistor R3). Internally, processor IC may read the voltage level (conditioned to a range of 0-5V, for example) and determine whether it is "on" or "off."

In various implementations, LED controller 400 may be a dimmable "white" LED controller that automatically adjusts color temperature by using at least two LED driver channel circuits, one for low and the other for high color temperature. In response to sensed on/off timing, processor IC generates a pulse width modulated (PWM) signal at a first output. That signal from the first output may activate a switching transistor Q1, which modulates power to the LED strip. In some implementations, the brightness of attached LEDs may be proportional to the duty cycle of the PWM signal. In some implementations, the frequency of the PWM signal may be high enough to avoid perceptible flicker, while low enough to avoid unwanted power radiation and radio interference. In a particular example implementation, a frequency on the order of a few hundred Hz may be considered optimal.

In some implementations, transistor Q1 alone may be used in a single LED driver channel circuit or single-channel controller implementations to modulate power to an LED strip for single-color applications. As such, the LED strip may be a single channel (e.g., white), and the LED driver channel circuit controls the brightness of the LED strip.

Various implementations described herein may also apply to multi-color applications utilizing multiple LED driver channel circuits (e.g., transistor Q1, transistor Q2, transistor Q3). The terms "LED driver channel circuits" and "LED channels" may be used interchangeably. In some implementations, one of the additional channels may be useful in single-color applications as well. Providing color temperature is one example. Feature choice is another example. In another example, one channel may have candlelight flicker at low levels, while another channel does not. In another example, two channels may be inter-modulated to effectuate animation.

In some implementations, for a multiple-channel controller, (e.g., Red, Green, Blue, optionally White), transistors Q1, Q2, and Q3 may be used, along with an optional Q4 (not shown). In various implementations, LED driver channel circuits (e.g., transistor Q1, transistor Q2, and transistor Q3 switch power to LEDs, employing PWM, which signal is generated by LED controller 400. As shown, transistors Q1, Q2, and Q3 connect to connector CON2 at pins labeled Red, Green, and Blue, and a pin labeled V+ of connector CON2 connects to the power supply. In some implementations, additional transistors may be used. In various implementations, transistors Q1, Q2, and Q3 all supply power to the LED strip, where power for each color is controlled separately. In some implementations, transistors Q1, Q2, and Q3 may brighten or dim all colors together.

In some implementations, diode D, resistor R1, and zener diode ZD may supply operating power (e.g., 5.1 V, etc.) to processor IC. In some implementations, capacitor C1 stores sufficient energy to keep processor IC running for a few seconds after the main power supply is turned off. Alternatively, processor power may be supplied by a separate power supply or battery. In various implementations, the processor power supply may incorporate an uninterruptible aspect that assures continued processor operation during power interruptions used for signaling. In some implementations, capacitor C2 may function as a decoupling capacitor. As the processor and transistors switch currents on and off, they are likely to induce undesired voltage spikes on the processor power pins. Capacitor C2 shorts out those transient switching currents, thereby decoupling them from the processor.

In some implementations, if four LED driver channel circuits are used (e.g., one for each of RGBW), they may emulate color temperature adjustment by mixing the channels in various proportions. For example, such colors may include white light at a predetermined color temperature (e.g., white, warm white, candlelight white, etc.). The particular number of LED driver channel circuits and color variations may vary, and will depend on the particular implementation. Other effects are possible. For example, in some implementations, software may be used with LED controller 400 to enable other lighting effects such as candlelight flicker, color changing, etc.

In some implementations, resistor R4 functions to quickly dissipate energy that may remain stored in the power supply after it is switched off. When LEDs are very dim, they use just a trickle of current. As such, when AC power is switched off, the LEDs may remain on for several seconds. Resistor R4 causes the LEDs to turn off more quickly, and enables the processor to sense the power off event more quickly, when AC power is switched off.

The pins of connector CON2 may connect to an LED strip. In various implementations, an LED strip (not shown) may consist of groups of a few LEDs (e.g., 3 or 6 LEDs) and a resistor in series. The number of LEDs in each group of LEDs and the value of the resistor may vary and would be chosen to work at a predetermined voltage. For example, the voltage may be 12 volts, 24 volts, etc. LED strips with higher and lower values are also possible.

LED Strips may be cut to length, at intervals that include an integer number of LED groups. Implementations may apply to one or more groups of LEDs/resistors (up to a predetermined current capability).

In some implementations, the resistors in the LED strip may constitute part of the LED driver channel circuit. In some implementations, the resistors in the LED strip may be outside the LED driver channel circuit. The particular circuit configuration may vary, and will depend on the particular implementation.

As indicated herein, particular implementations described herein are merely illustrative, and not restrictive. Various modifications are possible depending on the particular implementations. For example, in some implementations, an optional energy storage circuit may receive power from a switchable power line, either directly or via an intervening power supply, and store a sufficient amount of energy to maintain the functionality of other elements during periods in which necessary power is unavailable either directly from the switchable power line or from the intervening power supply. In some implementations, an optional energy storage device may be a capacitor of a sufficient capacity to keep the microprocessor running while decoding commands. In various implementations, both the power line and optional power supply may be either AC or DC.

In some implementations, a signal detection circuit detects timing characteristics of a sequence of power interruptions or other modulations carrying signal information. In some implementations, a signal decoding circuit detects data based on the timing or other modulation characteristics, where the data includes one or more operational commands. As indicated herein, the signal detection "circuit" is a microprocessor input pin, connected to power through a simple signal conditioner—probably a voltage divider. LED driver channel circuits may consist, in whole or in part, of output pins of the same microprocessor. In various implementations, their "drive modulation circuit" may be purely a software function, where there is no specific physical circuit. Signal decoding may similarly be a pure software function. LED driver channel circuit(s) may incorporate switching transistors activated by processor output pins.

Figure 5:
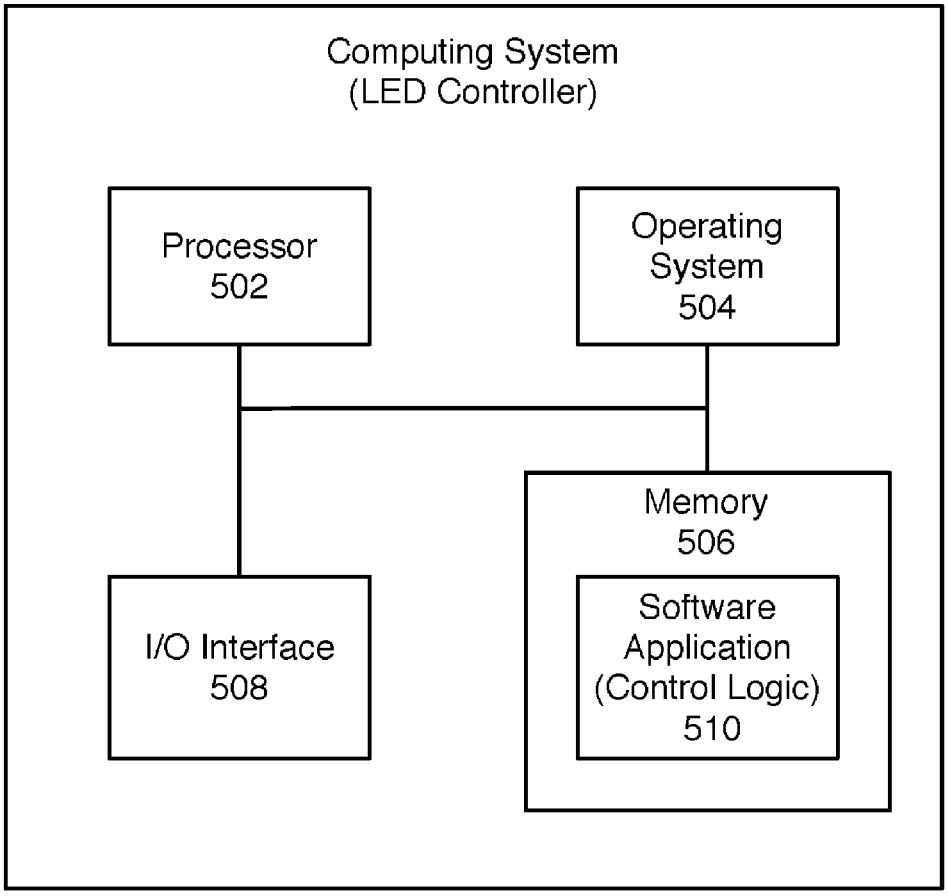
FIG. 5 illustrates a block diagram of an example computing system, which may be used for some implementations described herein.

FIG. 5 illustrates a block diagram of an example computing system 500, which may be used for some implementations described herein. For example, computing system 500 may be used to implement LED controller 200 of FIG. 2, as well as to perform implementations described herein. In some implementations, computing system 500 may include a processor 502, an operating system 504, a memory 506, and an input/output (I/O) interface 508. In various implementations, processor 502 may be used to implement various functions and features described herein, as well as to perform the method implementations described herein. While processor 502 is described as performing implementations described herein, any suitable component or combination of components of computing system 500 or any suitable processor or processors associated with computing system 500 or any suitable system may perform the steps described. Implementations described herein may be carried out on a user device, on a server, or a combination of both.

Computing system 500 also includes a software application 510, which may be stored on memory 506 or on any other suitable storage location or computer-readable medium. Software application 510 provides instructions that enable processor 502 to perform the implementations described herein and other functions. Software application may also include an engine such as a network engine for performing various functions associated with one or more networks and network communications. The components of computing system 500 may be implemented by one or more processors or any combination of hardware devices, as well as any combination of hardware, software, firmware, etc.

For ease of illustration, FIG. 5 shows one block for each of processor 502, operating system 504, memory 506, I/O interface 508, and software application 510. These blocks 502, 504, 506, 508, and 510 may represent multiple processors, operating systems, memories, I/O interfaces, and software applications. In various implementations, computing system 500 may not have all of the components shown and/or may have other elements including other types of components instead of, or in addition to, those shown herein.

Although the description has been described with respect to particular embodiments thereof, these particular embodiments are merely illustrative, and not restrictive. Concepts illustrated in the examples may be applied to other examples and implementations.

In various implementations, software is encoded in one or more non-transitory computer-readable media for execution by one or more processors. The software when executed by one or more processors is operable to perform the implementations described herein and other functions.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a non-transitory computer-readable storage medium (also referred to as a machine-readable storage medium) for use by or in connection with the instruction execution system, apparatus, or device. Particular embodiments can be implemented in the form of control logic in software or hardware or a combination of both. The control logic when executed by one or more processors is operable to perform the implementations described herein and other functions. For example, a tangible medium such as a hardware storage device can be used to store the control logic, which can include executable instructions.

Particular embodiments may be implemented by using a programmable general purpose digital computer, and/or by using application specific integrated circuits, programmable logic devices, field programmable gate arrays, optical, chemical, biological, quantum or nanoengineered systems, components and mechanisms. In general, the functions of particular embodiments can be achieved by any means as is known in the art. Distributed, networked systems, components, and/or circuits can be used. Communication, or transfer, of data may be wired, wireless, or by any other means.

A "processor" may include any suitable hardware and/or software system, mechanism, or component that processes data, signals or other information. A processor may include a system with a general-purpose central processing unit, multiple processing units, dedicated circuitry for achieving functionality, or other systems. Processing need not be limited to a geographic location, or have temporal limitations. For example, a processor may perform its functions in "real-time," "offline," in a "batch mode," etc. Portions of processing may be performed at different times and at different locations, by different (or the same) processing systems. A computer may be any processor in communication with a memory. The memory may be any suitable data storage, memory and/or non-transitory computer-readable storage medium, including electronic storage devices such as random-access memory (RAM), read-only memory (ROM), magnetic storage device (hard disk drive or the like), flash, optical storage device (CD, DVD or the like), magnetic or optical disk, or other tangible media suitable for storing instructions (e.g., program or software instructions) for execution by the processor. For example, a tangible medium such as a hardware storage device can be used to store the control logic, which can include executable instructions. The instructions can also be contained in, and provided as, an electronic signal, for example in the form of software as a service (SaaS) delivered from a server (e.g., a distributed system and/or a cloud computing system).

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What is claimed is:

1. A light emitting diode (LED) controller comprising:

one or more processors;

one or more LED driver channel circuits operatively coupled to and activatable by the one or more processors, wherein the one or more LED driver channel circuits supply modulated drive current to one or more LEDs; and logic encoded in one or more non-transitory computer-readable storage media for execution by the one or more processors and when executed operable to perform operations comprising:

receiving signaling modulations from a power line;

decoding data based on predetermined modulation characteristics of the signaling modulations, wherein the data includes one or more operational commands; and modifying performance parameters of the one or more LED driver channel circuits based on one or more of the operational commands, wherein the performance parameters effect brightness levels of one or more LEDs connected to the one or more LED driver channel circuits.

2. The LED controller of claim 1, wherein the logic when executed is further operable to perform operations comprising detecting and decoding signals modulated at a predetermined synchronizing frequency.

3. The LED controller of claim 1, wherein the data to be decoded is encoded by modulating a subset of alternating current (AC) cycles of drive current to in turn provide modulated drive current to the one or more LEDs, wherein modulated AC cycles transmit data, and wherein unmodulated AC cycles supply power to the one or more LEDs.

4. The LED controller of claim 1, wherein the data to be decoded is encoded manually at a light switch.

5. The LED controller of claim 1, wherein the data to be decoded is encoded at a remote digital device.

6. The LED controller of claim 1, wherein the data to be decoded is encoded by one or more data encoding devices, wherein the operational commands received solicit a response from the LED controller, and wherein the logic when executed is further operable to perform operations comprising encoding responsive data.

7. The LED controller of claim 1, wherein the predetermined modulation characteristics of the signaling modulations comprise power interruptions.

8. The LED controller of claim 1, wherein the LED controller is one LED controller of a plurality of LED controllers, wherein the one or more operational commands are selectively sent by one or more data encoding devices to the one or more LED controllers via one or more respective power lines, wherein each of the one or more LED controllers thereby assumes either a selected status or an unselected status with respect to the one or more operational commands, and wherein each LED controller either acts upon or ignores the one or more operational commands based on its selected status or unselected status.

9. A system comprising:

one or more light emitting diode (LED) controllers that each include one or more LED driver channel circuits that supply modulated drive current to one or more LEDs, wherein each LED controller performs operations comprising:

receiving signaling modulations from a power line;

decoding data based on predetermined modulation characteristics of the signaling modulations, wherein the data includes one or more operational commands; and modifying performance parameters of the one or more LED driver channel circuits based on one or more of the operational commands, and wherein the performance parameters effect brightness levels of the one or more LEDs connected to the one or more LED driver channel circuits.

10. The system of claim 9, wherein each LED controller further performs operations comprising detecting and decoding signals modulated at a predetermined synchronizing frequency.

11. The system of claim 9, wherein the data to be decoded is encoded by modulating a subset of alternating current (AC) cycles of drive current to in turn provide modulated drive current to the one or more LEDs, wherein modulated AC cycles transmit data, and wherein unmodulated AC cycles supply power to the one or more LEDs.

12. The system of claim 9, wherein the data to be decoded is encoded manually at a light switch.

13. The system of claim 9, wherein the data to be decoded is encoded at a remote digital device.

14. The system of claim 9, wherein the data to be decoded is encoded by one or more data encoding devices, wherein the operational commands received solicit a response from one or more of the LED controllers, and wherein each LED controller is further operable to perform operations comprising encoding responsive data.

15. The system of claim 9, wherein the predetermined modulation characteristics of the signaling modulations comprise power interruptions.

16. The system of claim 9, wherein one or more of the operational commands are selectively sent by one or more data encoding devices to the one or more LED controllers via one or more respective power lines, wherein each of the one or more LED controllers thereby assumes either a selected status or an unselected status with respect to the one or more operational commands, and wherein each LED controller either acts upon or ignores the one or more operational commands based on its selected status or unselected status.

17. A computer-implemented method comprising:

receiving signaling modulations from a power line;

decoding data based on predetermined modulation characteristics of the signaling modulations, wherein the data includes one or more operational commands; and modifying performance parameters of one or more LED driver channel circuits based on one or more of the operational commands, wherein the one or more LED driver channel circuits supply modulated drive current to one or more LEDs, and wherein the performance parameters effect brightness levels of the one or more LEDs connected to the one or more LED driver channel circuits.

18. The method of claim 17, wherein the LED controller further performs operations comprising detecting and decoding signals modulated at a predetermined synchronizing frequency.

19. The method of claim 17, wherein the data to be decoded is encoded by modulating a subset of alternating current (AC) cycles of drive current to in turn provide modulated drive current to the one or more LEDs, wherein modulated AC cycles transmit data, and wherein unmodulated AC cycles supply power to the one or more LEDs.

20. The method of claim 17, wherein the data to be decoded is encoded manually at a light switch.

* * * * *